US005379591A

United States Patent [19]

Iwata et al.

[11] Patent Number: 5,379,591

[45] Date of Patent: Jan. 10, 1995

[54] AIR-FUEL RATIO CONTROL SYSTEM FOR INTERNAL COMBUSTION ENGINES

[75] Inventors: Yoichi Iwata; Naoki Iida; Tsuyoshi Takizawa; Yasunari Seki; Toshihiko Sato, all of Wako; Takayoshi Nakayama, Tochigi, all of Japan

[73] Assignee: Honda Giken Kogyo Kabushiki Kaisha, Tokyo, Japan

[21] Appl. No.: 187,724

[22] Filed: Jan. 28, 1994

[30] Foreign Application Priority Data

Jan. 29, 1993 [JP] Japan ..... 5-034932

[51] Int. Cl.[6] ..... F01N 3/22

[52] U.S. Cl. ..... 60/276; 60/277; 60/285; 123/703

[58] Field of Search ..... 60/274, 276, 277, 285; 123/672, 674, 703

[56] References Cited

U.S. PATENT DOCUMENTS

| | | | |
|---|---|---|---|
| 4,106,448 | 8/1978 | Noguchi | 60/285 |
| 5,074,113 | 12/1991 | Matsuoka | 60/285 |
| 5,090,199 | 2/1992 | Ikuta | 60/276 |
| 5,154,055 | 10/1992 | Nakane | 60/277 |
| 5,228,286 | 7/1993 | Demura | 60/285 |
| 5,247,793 | 9/1993 | Yamada | 60/277 |
| 5,279,114 | 1/1994 | Kurita | 60/276 |
| 5,280,707 | 1/1994 | Nakashima | 60/285 |
| 5,311,737 | 5/1994 | Komatsu | 60/285 |
| 5,325,664 | 7/1994 | Seki | 60/276 |

*Primary Examiner*—Ira S. Lazarus
*Assistant Examiner*—Daniel J. O'Connor
*Attorney, Agent, or Firm*—Nikaido, Marmelstein, Murray & Oram

[57] ABSTRACT

An air-fuel ratio control system for an internal combustion engine calculates an air-fuel ratio feedback control parameter by proportional-integral control using a proportional factor and an integral factor, based an output signal from a second air-fuel ratio sensor arranged in an exhaust passage at a location upstream of a catalytic converter. An air-fuel ratio correction amount is calculated based on the air-fuel ratio feedback control parameter and an output signal from a first air-fuel ratio sensor arranged in the exhaust passage at a location upstream of the catalytic converter. An inversion period of the output signal from the second air-fuel ratio sensor is measured, and the proportional factor is changed according to the inversion period measured.

5 Claims, 11 Drawing Sheets

INTERNAL COMBUSTION ENGINE
CATALYTIC CONVERTER
O2
O2
CYL
NE
TW
TA
PBA
θ TH
FUEL INJECTION VALVE
INPUT CIRCUIT
C P U
MEMORY MEANS
OUTPUT CIRCUIT
ECU
1
2
3
3'
4
5
5a
5b
5c
5d
6
7
8
9
10
11
12
13
14
16
17

DETERMINATION OF KO2
S1
TW>TWO2 ?
NO
YES
S2
FWOT=0 ?
NO
YES
S3
NO
UPSTREAM O2 SENSOR ACTIVATED?
YES
S4
NE>NHOP ?
YES
NO
S5
NE≦NLOP ?
YES
NO
S6
F/C ?
YES
NO
S7
KLS=1.0 ?
NO
YES
S10
KO2←KREF
S8
PERFORM UPSTREAM O2 SENSOR-BASED F/B CONTROL
S9
KO2←1.0
EXIT

UPSTREAM O2 SENSOR-BASED F/B CONTROL
INITIALIZE FAF1,FAF2
S21
INITIALIZE KO2
S22
S23
KO2 INITIALIZED IN PRESENT LOOP?
YES
NO
S24
FVO2<FVREF ?
NO
YES
S25
FAF1←0
CDLY1←CDLY−1
S28
FAF1←1
CDLY1←CDLY+1
S26
CDLY1<TDR1 ?
NO
S29
CDLY1>TDL1 ?
NO
YES
S27
CDLY1←TDR1
YES
S30
CDLY1←TDL1
S31
CDLY1 INVERTED?
NO
YES
S32
FAF1=0 ?
NO
YES
S39
FAF2=0 ?
NO
YES
A
B
C
D

AIR-FUEL RATIO CONTROL SYSTEM FOR INTERNAL COMBUSTION ENGINES

BACKGROUND OF THE INVENTION

1. Field of the Invention

This invention relates to an air-fuel ratio control system for an internal combustion engine, and more particularly to an air-fuel ratio control system for an internal combustion engine adapted to control the air-fuel ratio of an air-fuel mixture supplied to the engine based on output signals from air-fuel ratio sensors arranged in an exhaust passage at respective locations upstream and downstream of a catalytic converter, the output signals being inverted between a richer side and a leaner side with respect to a reference value when the air-fuel ratio of the mixture changes across a stoichiometric air-fuel ratio.

2. Prior Art

Conventionally, an air-fuel ratio control system for an internal combustion engine has been proposed by Japanese Provisional Patent Publication (Kokai) No. 58-48756, which includes, in addition to an air-fuel ratio sensor ($O_2$ sensor) arranged in an exhaust passage at a location upstream of a catalytic converter, an $O_2$ sensor arranged in the exhaust passage at a location downstream of the catalytic converter to compensate for an undesired variation among individual $O_2$ sensors to be arranged upstream of the catalytic converter with respect to the output characteristic thereof, to thereby more accurately feedback-control the air-fuel ratio of the mixture based on an output signal from the upstream $O_2$ sensor as well as an output signal from the downstream $O_2$ sensor.

The downstream $O_2$ sensor provided in the proposed air-fuel ratio control system detects the air-fuel ratio of the mixture supplied to the engine with a delay caused by oxygen storage effect of the catalytic converter. Therefore, if the repetition period of the inversion of the output signal from the downstream $O_2$ sensor is long, an actual value of the air-fuel ratio of the mixture supplied to the engine can be largely deviated from the stoichiometric air-fuel ratio toward the richer side or leaner side when the signal delivered from the downstream $O_2$ sensor is inverted with respect to a reference value or drastically changes. Although the air-fuel ratio of the mixture is controlled on average to the stoichiometric air-fuel ratio in such cases, the actual value of the air-fuel ratio of the mixture supplied to the engine undergoes an alternate large variation toward the richer side and the leaner side.

FIGS. 1*a* to 1*d* show an example of changes in the output signal FVO2 delivered from the upstream $O_2$ sensor, the output signal RVO2 delivered from the downstream $O_2$ sensor, and an air-fuel ratio correction coefficient KO2, when the repetition period of inversion of the signal delivered from the downstream $O_2$ sensor is relatively large.

As shown in FIG. 1*a*, the output voltage FVO2 from the upstream $O_2$ sensor undergoes prompt and frequent inversion between the richer side and the leaner side in response to changes in the air-fuel ratio of the mixture supplied to the engine since this sensor is free from the influence of oxygen storage effect of the catalytic converter. In contrast, the output RVO2 from the downstream $O_2$ sensor is inverted at long time intervals. That is, with this sensor, relatively-long durations of the rich side output and the learner side output alternately occur.

More specifically, as shown in FIG. 1*c*, immediately after the output signal RVO2 from the downstream $O_2$ sensor 17 has been inverted from the leaner side to the richer side, an enriching feedback control parameter PR assumes a maximum value and a leaning feedback control parameter PL assumes a minimum value, as shown in FIG. 1*c*, so that the air-fuel ratio correction coefficient KO2, which is determined by the alternate use of these P terms, continues to increase for some time in spite of respective stepwise decrease and increase of the feedback control parameters after the inversion of the output signal. On the other hand, immediately after the output signal $RVO_2$ from the downstream $O_2$ sensor 17 has been inverted from the richer side to the leaner side, the enriching feedback control parameter PR assumes a minimum value and the leaning feedback control parameter PL assumes a maximum value, as shown in FIG. 1*c*, so that the air-fuel ratio correction coefficient KO2 continues to decrease for some time in spite of respective stepwise decrease and increase of the feedback control parameters after the inversion of the output signal. As shown in FIG. 1*d*, after the enriching feedback control parameter PR is decreased to a minimum value m and the leaning feedback control parameter PL is increased to a maximum value n, at a time point corresponding to inversion of the output signal RVO2 from the richer side to the leaner side, the enriching feedback control parameter PR and the leaning feedback control parameter PL start to be increased and decreased, respectively. Then, when a maximum value o and a minimum value p are reached at a time point corresponding to inversion of the output signal RVO2 from the leaner side to the richer side, the enriching feedback control parameter PR and the leaning feedback control parameter PL start to be decreased and increased, respectively. Thus, the air-fuel ratio correction coefficient KO2 is controlled such that a waveform indicative of changes in the air fuel ratio correction coefficient KO2 has an envelope convergent to a desired air-fuel ratio (stoichiometric air-fuel ratio). However, since the correction coefficient KO2 is varied depending on the maximum value and the minimum value or the maximum value or the minimum value respectively assumed by the enriching feedback control parameter PR and the leaning feedback control parameter PL when the output signal RVO2 from the downstream $O_2$ sensor 17 is inverted, so that the output signal RVO2 from the downstream $O_2$ sensor 17 as a result of the feedback control by the use of the correction coefficient KO2 alternately continues to be on the richer side and the leaner side with relatively long durations. Particularly, when the output voltage RVO2 of the downstream $O_2$ sensor is inverted after a long duration of the output signal on the richer or leaner side, the air-fuel ratio correction coefficient KO2 can be largely deviated from the desired value, resulting in degraded exhaust emission characteristics, i.e. emission of noxious components, such as CO, HC, and NOx, and degraded performance of the engine.

To solve problems in the air-fuel ratio control described above, air-fuel ratio control systems have been proposed e.g. by Japanese Provisional Patent Publication (Kokai) No. 63-120835 (hereinafter referred to "the first prior art") and Japanese Provisional Patent Publication (Kokai) No. 63-195350 (hereinafner referred to as "the second prior art"), the former being adapted to inhibit the air-fuel ratio feedback control based on the downstream $O_2$ sensor, and the latter being adapted to increase a gain of an integral factor (I term) of the proportional-integral control (PI control) responsive to the output signal from the downstream $O_2$ sensor, when the repetition period of inversion of the output signal is long.

In the first prior art, however, when the repetition period of inversion of the output signal from the downstream $O_2$ sensor is long, the air-fuel ratio feedback control based on the output signal from the downstream $O_2$ sensor is merely inhibited, and hence there is no difference from the air-fuel ratio feedback control by the use of only one $O_2$ sensor arranged upstream of the catalytic converter. Therefore, it is impossible to compensate for variation in output characteristics of individual upstream $O_2$ sensors when the repetition period of the output signal from the downstream $O_2$ sensor is long, setting a limit to accuracy of the air-fuel ratio feedback control.

In the second prior art, the gain of the integral factor applied to the PI control for calculation of the feedback control parameters used in the air-fuel ratio feedback control is increased when the repetition period of inversion of the output signal from the downstream $O_2$ sensor is long. However, it merely increases a rate of change in the integral factor per unit time. Therefore, it is difficult for the second prior art to promptly control the air-fuel ratio of the mixture supplied to the engine to the desired air-fuel ratio.

SUMMARY OF THE INVENTION

It is the object of the invention to provide an air-fuel ratio control system for an internal combustion engine which is capable of suppressing variation in the air-fuel ratio of a mixture supplied to the engine to the minimum level even if the repetition period of inversion of an output signal from a downstream $O_2$ sensor is relatively long.

To attain the above object, the present invention provides an air-fuel ratio control system for an internal combustion engine having an exhaust passage, a catalytic converter arranged in the exhaust passage for purifying noxious components contained in exhaust gases including a first air-fuel ratio sensor arranged in the exhaust passage at a location upstream of the catalytic converter, and a second air-fuel ratio sensor arranged in the exhaust passage at a location downstream of the catalytic converter, air-fuel ratio feedback control parameter-calculating means for calculating an air-fuel ratio feedback control parameter, by proportional-integral control using a proportional factor and an integral factor, based on an output signal from the second air-fuel ratio sensor, and air-fuel ratio correction amount-calculating means for calculating the air-fuel ratio correction amount based on the air-fuel ratio feedback control parameter and an output signal from the first air-fuel ratio sensor.

The air-fuel ratio control system according to the invention is characterized by comprising:

inversion period-measuring means for measuring a repetition period of inversion of the output signal from the second air-fuel ratio sensor with respect to a reference value; and proportional factor-changing means for changing the proportional factor according to the repetition period of inversion of the output signal from the second air-fuel ratio sensor detected by the repetition period-measuring means.

According to the invention, as shown in FIG. 9, the inversion period of the output signal from the second air-fuel ratio sensor ($RO_2$ sensor) 17 arranged downstream of the catalytic converter is measured by the inversion period-measuring means 51, and the proportional factor-changing means 52 changes the proportional factor 54 for use in calculation of the air-fuel ratio feedback control parameter by the air-fuel ratio feedback control parameter-calculating means 53, according to the inversion period measured. The air-fuel ratio feedback control parameter calculated based on the resulting proportional factor is supplied to the air-fuel ratio correction amount-calculating means 56, together with other control parameters including the output signal from the first air-fuel ratio sensor ($FO_2$ sensor) 16 arranged upstream of the catalytic converter. The air-fuel ratio correction amount-calculating means 56 calculates and delivers the air-fuel ratio correction amount based on these parameters.

According to the air-fuel ratio control system having the above-construction, the proportional factor for use in calculation of the air-fuel ratio feedback parameter is changed according to the inversion period of the second air-fuel ratio sensor. Therefore, it is possible to suppress undesired variations in the air-fuel ratio of a mixture supplied to the engine, and perform the air-fuel ratio control with excellent responsiveness, even if the inversion period of the output signal from the second air-fuel ratio sensor arranged downstream of the catalytic converter is long.

Preferably, the proportional factor-changing means sets the proportional factor to a larger value as the repetition period of inversion of the output signal from the second air-fuel ratio sensor becomes longer.

More preferably, the air-fuel ratio feedback control parameter is comprised of a leaning feedback control parameter applied in changing the air-fuel ratio of a mixture in a leaning direction, and an enriching feedback control parameter applied in changing the air-fuel ratio of the mixture in an enriching direction.

Preferably, the calculation of the air-fuel ratio feedback control parameter by the air-fuel ratio feedback control parameter-calculating means is permitted to be executed, when the engine is in a predetermined steady operating condition.

Further preferably, the air-fuel ratio sensor includes learned value-calculating means for calculating a learned value of the air-fuel ratio feedback control parameter, with the learned value-calculating means calculating the learned value when calculation of the air-fuel ratio feedback control parameter is permitted, and the air-fuel ratio correction amount-calculating means calculating the air-fuel ratio correction amount based on the learned value when the calculation of the air-fuel ratio feedback control parameter is inhibited, when the calculation of the air-fuel ratio feedback control parameter by said air-fuel ratio feedback control parameter-calculating means is inhibited.

The above and other objects, features, and advantages of the invention will become more apparent from the following detailed description taken in conjunction with the accompanying drawings.

BRIEF DESCRIPTION OF THE DRAWINGS

FIG. 1*a* to FIG. 1*d* collectively form a timing chart which is useful in explaining a manner of the air-fuel ratio feedback control performed by a conventional air-fuel ratio control system, based output signals from on upstream and downstream $O_2$ sensors, in which:

FIG. 1*a* is a diagram showing an example of changes in an output signal FVO2 from an upstream $O_2$ sensor of a conventional air-fuel ratio control system;

FIG. 1*b* is a diagram showing an example of changes in an output RVO2 from a downstream $O_2$ sensor of the conventional system;

FIG. 1*c* is a diagram showing the relationship between an enriching correction variable PR and a leaning correction variable PL applied to an air-fuel ratio correction coefficient KO2 used in the conventional system; and FIG. 1*d* is a diagram showing changes in the enriching feedback control parameter PR and the leaning feedback control parameter PL;

FIG. 8*a* to FIG. 8*c* collectively form a timing chart which is useful in explaining manners of changes in the enriching feedback control parameter PR and the leaning feedback control parameter PL, in which:

FIG. 8*a* is a diagram showing changes in the output signal RVO2 from the downstream $O_2$ sensor;

FIG. 8*b* is a diagram showing changes in the enriching feedback control parameter PR in comparison with the prior art;

FIG. 8*c* is a diagram showing changes in the leaning feedback control parameter PL in comparison with the prior art.

DETAILED DESCRIPTION

The invention will be described in detail with reference to drawings showing an embodiment thereof.

Figure 1A:
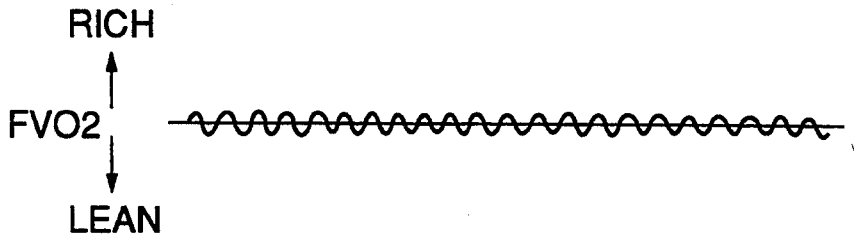
Figure 1B:
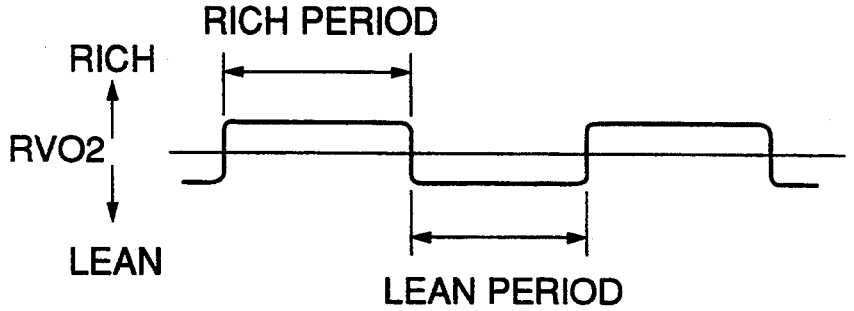
Figure 1C:
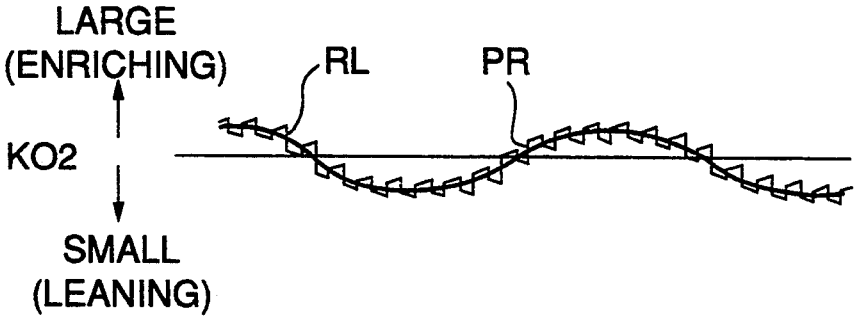
Figure 1D:
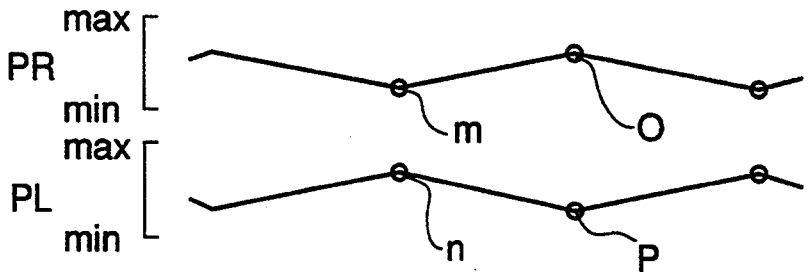
Figure 2:
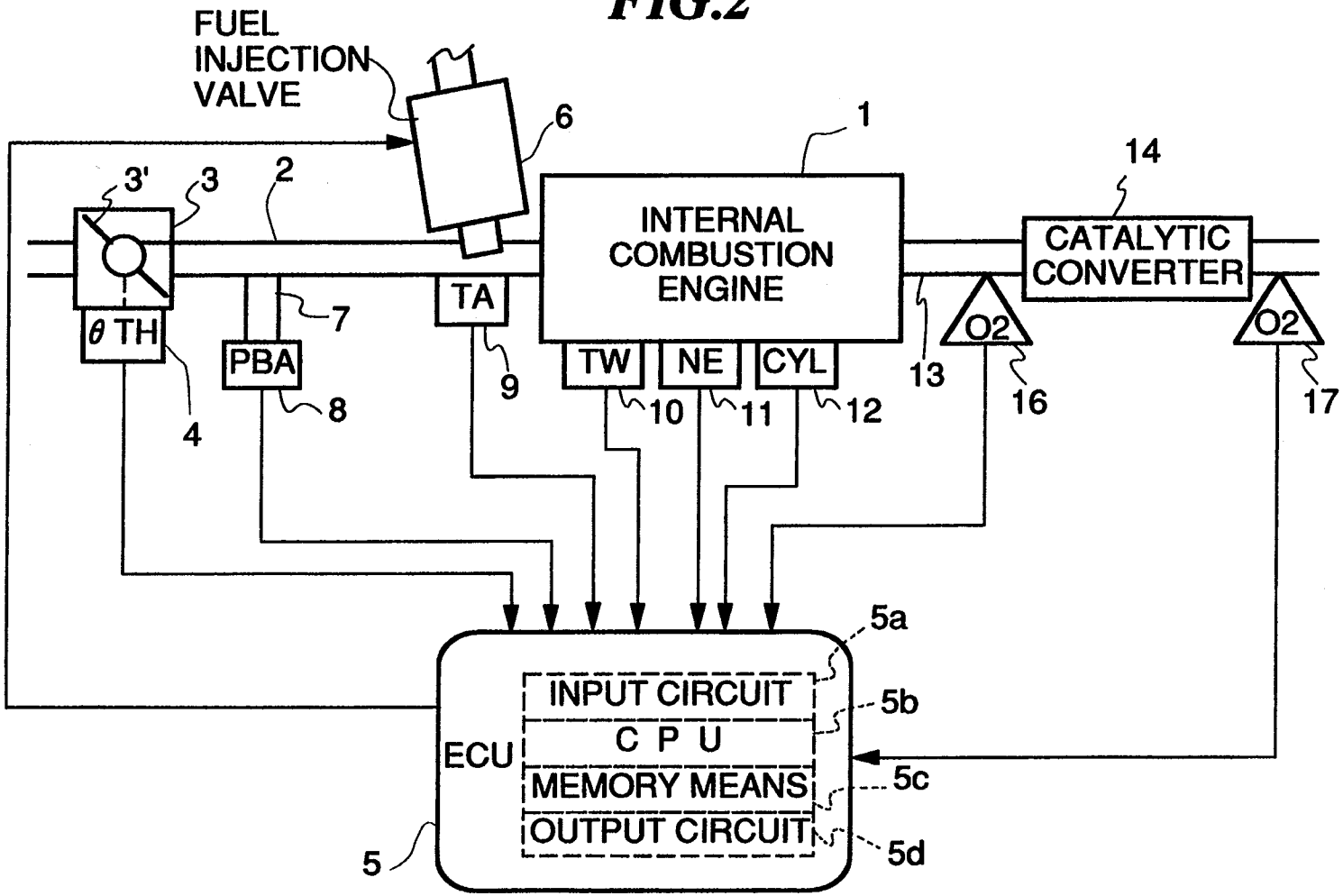
FIG. 2 is a block diagram showing the whole arrangement of an air-fuel ratio control system for an internal combustion engine according to an embodiment of the invention.

Referring first to FIG. 2, there is shown the whole arrangement of an air-fuel ratio control system for an internal combustion engine according the embodiment.

In the figure, reference numeral 1 designates a DOHC straight type four-cylinder engine (hereinafter simply referred to as "the engine"), each cylinder being provided with a pair of intake valves, not shown, and a pair of exhaust valves, not shown. Connected to an intake port, not shown, of the cylinder block of the engine 1 is an intake pipe 2 across which is arranged a throttle body 3 accommodating a throttle valve 3' therein. A throttle valve opening ($\theta$TH) sensor 4 is connected to the throttle valve 3' for generating an electric signal indicative of the sensed throttle valve opening $\theta$TH and supplying same to an electronic control unit (hereinafter referred to as "the ECU") 5.

Fuel injection valves 6, only one of which is shown, are inserted into the intake pipe 2 at locations intermediate between the cylinder block of the engine 1 and the throttle valve 3' and slightly upstream of the respective intake valves. The fuel injection valves 6 are connected to a fuel pump, not shown, via a fuel supply pipe, and electrically connected to the ECU 5 to have their valve opening periods controlled by signals therefrom.

Further, an intake pipe absolute pressure (PBA) sensor 8 is provided in communication with the interior of the intake pipe 2 via a conduit line 7 opening into the intake pipe 2 at a location downstream of the throttle valve 3' for supplying an electric signal indicative of the sensed absolute pressure PBA within the intake pipe 2 to the ECU 5.

An intake air temperature (TA) sensor 9 is inserted into the intake pipe 2 at a location downstream of the conduit 7 for supplying an electric signal indicative of the sensed intake air temperature TA to the ECU 5.

An engine coolant temperature (TW) sensor 10 formed of a thermistor or the like is inserted into a coolant passage filled with a coolant and formed in the cylinder block, for supplying an electric signal indicative of the sensed engine coolant temperature TW to the ECU 5.

An engine rotational speed (NE) sensor 11 and a cylinder discriminating (CYL) sensor 12 are arranged in facing relation to a camshaft or a crankshaft of the engine 1, neither of which is shown. The NE sensor 11 generates a pulse as a TDC signal pulse at each of predetermined crank angles whenever the crankshaft rotates through 180 degrees, while the CYL sensor 12 generates a pulse as a CYL signal pulse at a predetermined crank angle for a particular cylinder of the engine 1, both of the pulses being supplied to the ECU 5.

A catalytic converter (three-way catalyst) 14 is arranged in an exhaust pipe 13 connected to an exhaust port, not shown, of the engine 1 for purifying noxious components, such as HC, CO, NOx, which are present in exhaust gases.

Arranged in the exhaust pipe 13 at respective locations upstream and downstream of the catalytic converter 14 are oxygen concentration sensors 16 and 17 (hereinafter referred to as "the upstream $O_2$ sensor 16" and "the downstream $O_2$ sensor 17", respectively) for detecting concentration of oxygen present in the exhaust gases at the respective locations, and supplying signals indicative of the sensed oxygen concentration to the ECU 5. The upstream and downstream $O_2$ sensors 16, 17 are each comprised of a sensor element formed of a solid electrolyte, zirconia (ZrO2), and each have an output characteristic that when the air-fuel ratio of an air-fuel mixture, which is burnt and guided to the sensors for detection of oxygen concentration of the resulting burnt or exhaust gases, changes across a stoichiometric value, the electromotive force thereof drastically changes, inverting its output signal between a side (hereinafter referred to as "the richer side") indicative of a richer (smaller) value of the air-fuel ratio and a side (hereinafter referred to as the "leaner side") indicative of a leaner (larger) value of same with respect to the stoichiometric value. More specifically, the output signals (i.e. output voltages) from these sensors are at a higher level (on the richer side) when the exhaust gases are of a rich air-fuel ratio, and at a lower level (on the leaner side) when the exhaust gases are of a lean air-fuel ratio.

The ECU 5 comprises an input circuit 5*a* having the functions of shaping the waveform of input signals from various sensors as mentioned above, shifting the voltage levels of sensor output signals to a predetermined level, converting analog signals from analog-output sensors to digital signals, and so forth, a central processing unit (hereinafter referred to as "the CPU") 5*b*, memory means 5*c* storing various operational programs which are executed by the CPU 5*b*, and for storing calculation results therefrom, etc. and an output circuit 5*d* which delivers driving signals to the fuel injection valves 6.

The CPU 5*b* operates in response to the abovementioned signals from the sensors to determine operating conditions in which the engine 1 is operating, such as an air-fuel ratio feedback control region in which the air-fuel ratio feedback control is performed in response to oxygen concentration of the exhaust gases, and open-loop control regions, and calculates, based upon the determined engine operating conditions, the valve opening period or a fuel injection period Tout over which the fuel injection valves 6 are to be opened in synchronism with generation of TDC signal pulses, by the use of the following equation (1):

$$Tout = Ti \times KO2 \times KLS \times K1 + K2 \quad (1)$$

where Ti represents a basic fuel amount, i.e. a basic value of the fuel injection period Tout, which is determined according to the engine rotational speed NE and the intake pipe absolute pressure PBA and read from a Ti map stored in the memory means 5*c*.

KO2 represents an air-fuel ratio correction coefficient which is determined based on outputs from the upstream and downstream $O_2$ sensors 16 and 17. The correction coefficient KO2 is determined by executing a KO2-determining routine, described hereinafter.

KLS represents an air-fuel ratio-leaning coefficient, which is set to a predetermined value smaller than 1.0 when the engine is in a predetermined low load condition, while it is set to a value of 1.0 when the engine is in conditions other than the low load condition.

K1 and K2 represent other correction coefficients and correction variables, respectively, which are set according to engine operating parameters to such values as optimize engine operating characteristics, such as fuel consumption and engine accelerability.

Figure 3:
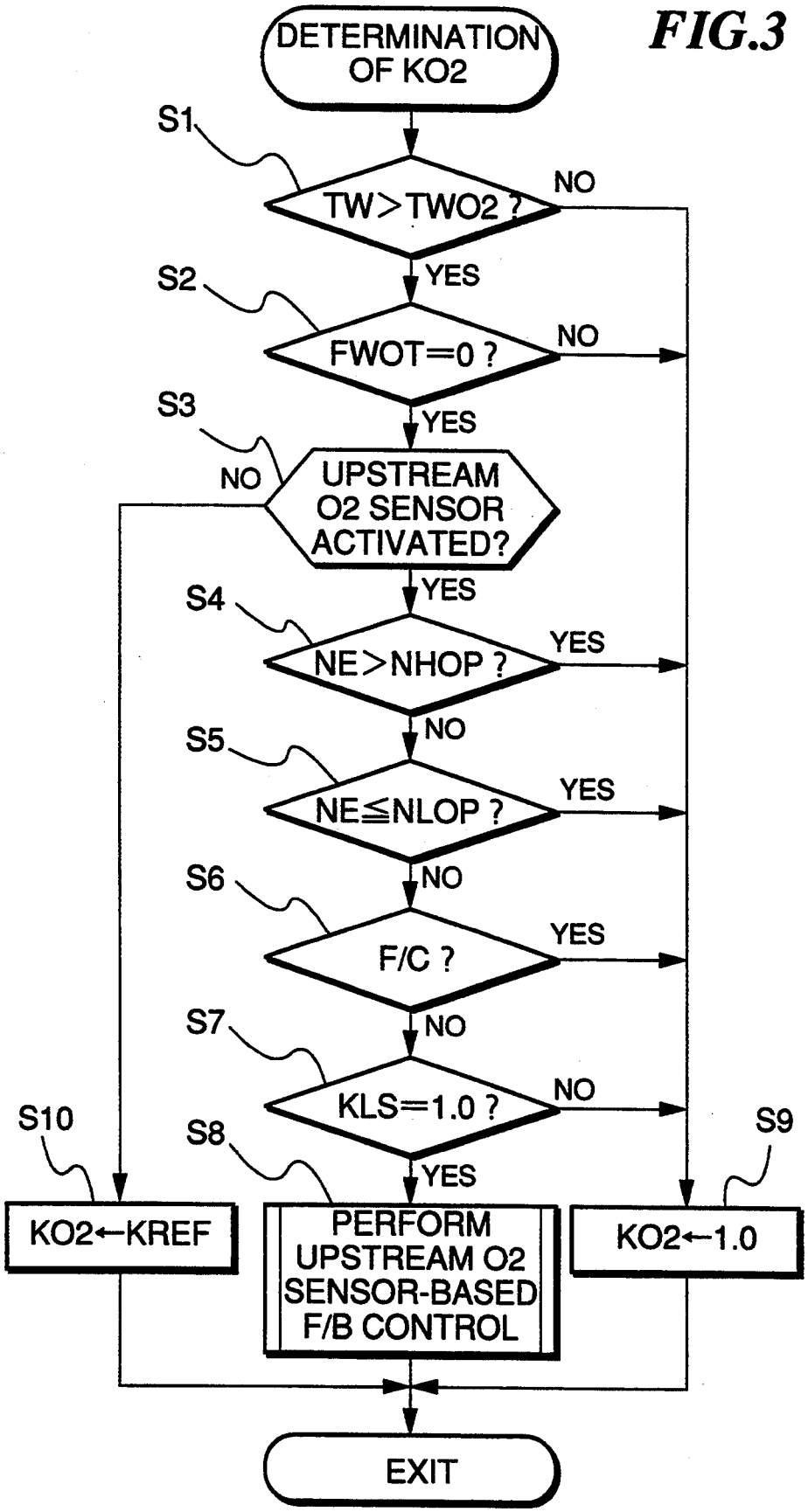
FIG. 3 is a flowchart of a KO2-determining routine for determining the air-fuel ratio correction coefficient KO2, which is executed by the air-fuel ratio control system of FIG. 2.

FIG. 3 shows the KO2-determining routine for determining the air-fuel ratio correction coefficient KO2, which is executed in synchronism with false signal pulses generated by a timer, not shown, incorporated in the ECU 5, at predetermined fixed time intervals (e.g. 5 msec).

At steps S1 to S7, it is determined whether or not the feedback control based on the output signal FVO2 from the upstream $O_2$ sensor 16 is permitted. Specifically, it is determined whether or not an engine coolant temperature TW is higher than a first predetermined engine coolant temperature TWO2 (e.g. 25° C.) at the step S1, whether or not a flag FWOT which is set to a value of 1 when the engine is in a predetermined high load operating condition is equal to a value of 0 at the step S2, whether or not the upstream $O_2$ sensor 16 has been activated at the step S3, whether or not the engine rotational speed NE is higher than a predetermined higher engine rotational speed NHOP at the step S4, whether or not the engine rotational speed NE is equal to or smaller than a predetermined lower engine rotational speed NLOP at the step S5, whether or not the engine is under fuel cut at the step S6, and whether or not the air-fuel ratio-leaning coefficient KLS is equal to a value of 1.0 at the step S7. When the engine coolant temperature TW is higher than the predetermined engine coolant temperature TWO2, when FWOT=0, when the engine is not in the predetermined high load engine operating condition, when the upstream $O_2$ sensor 16 has been activated, when the engine rotational speed NE falls within a range of NLOP<NE≦NHOP, when the engine is not under fuel cut, when KLS=1.0, i.e. when the engine is not in the predetermined low load condition, it is determined that the conditions for performing the air-fuel ratio feedback control based on the output signal FVO2 from the upstream $O_2$ sensor 16 are satisfied, and then the program proceeds to a step S8, where the correction coefficient KO2 is calculated by executing an upstream $O_2$ sensor-based air-fuel ratio feedback control routine, described hereinafter.

Further, if both of TW>TWO2 and FWOT=0 are satisfied and at the same time the upstream $O_2$ sensor 16 is inactivated, the program jumps over to a step S10, where the correction coefficient KO2 is set to a learned value KREF calculated during the feedback control at the step S8. If any one of the feedback control-effecting conditions other than that of the step S3 is not satisfied, the program proceeds to a step S9, where the correction coefficient KO2 is set to a value of 1.0.

Figure 4A:
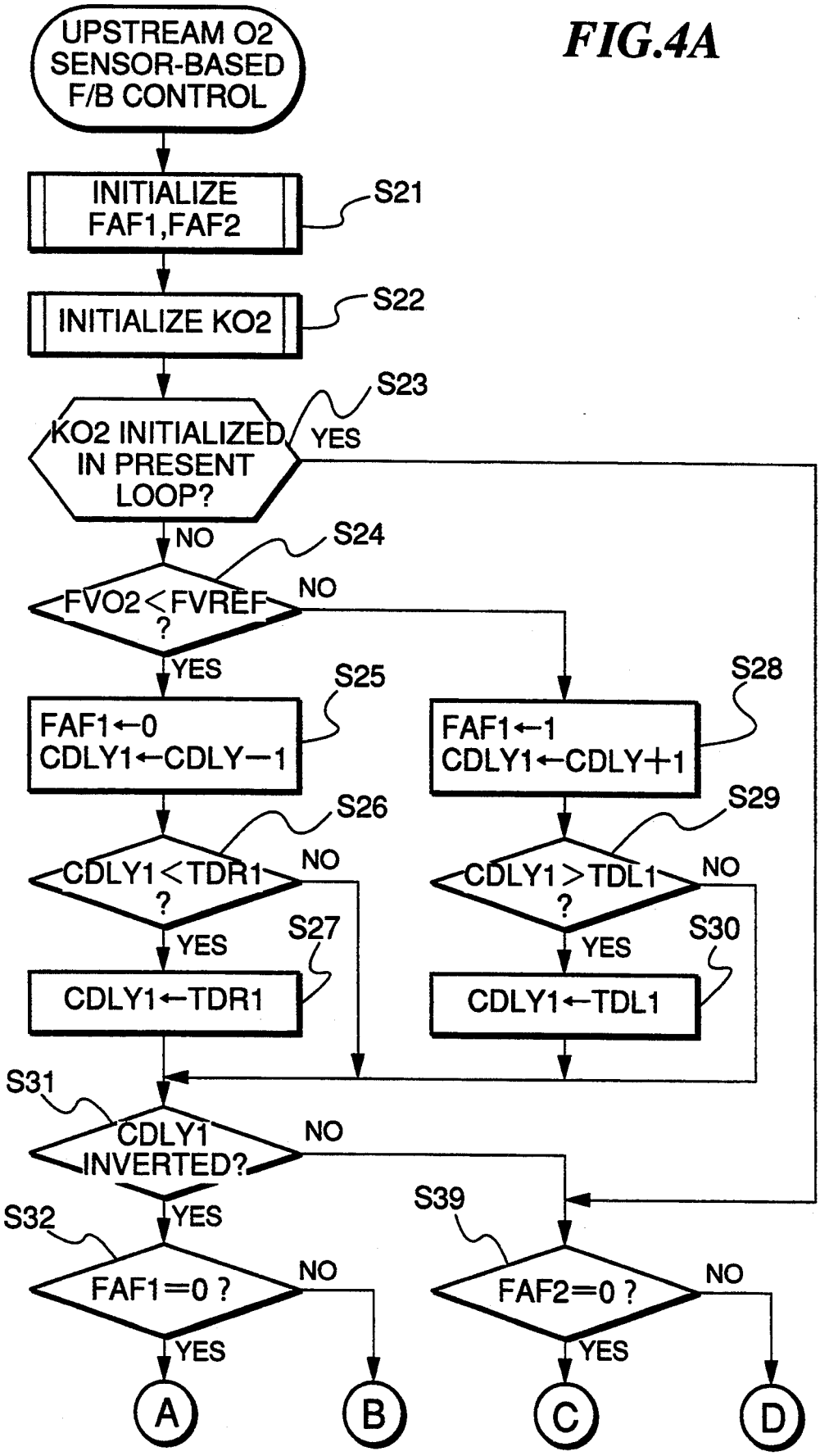
FIG. 4*a* is part of a flowchart showing a program of an upstream $O_2$ sensor-based air-fuel ratio feedback control executed by the system based on an output signal from an upstream $O_2$ sensor thereof for determining the air-fuel ratio correction coefficient KO2.
Figure 4B:
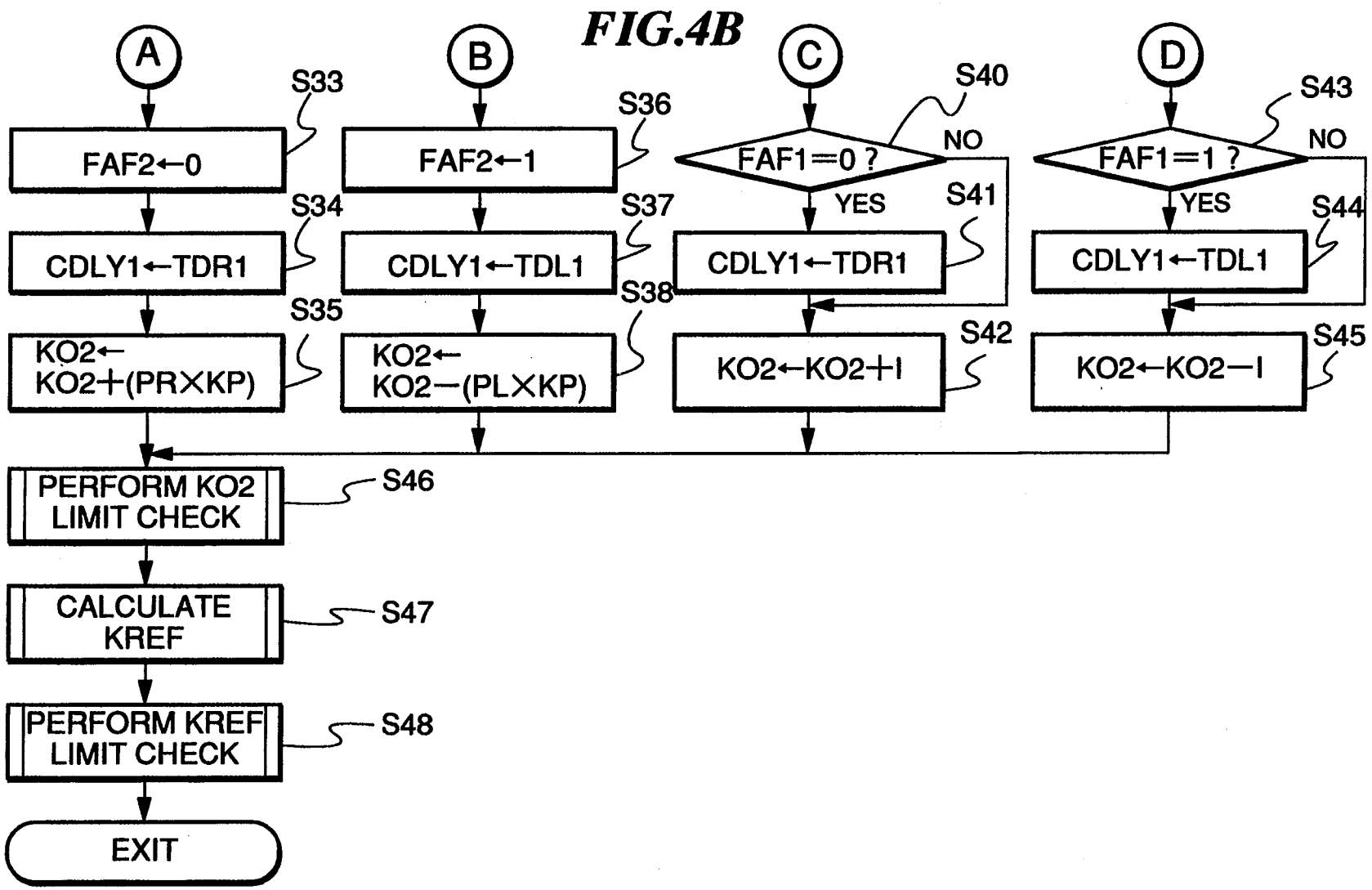
FIG. 4*b* is the remaining part of the FIG. 4*a* flowchart.

FIGS. 4*a* and 4*b* show the upstream $O_2$ sensor-based air-fuel ratio feedback control routine executed at the step S8 of FIG. 3, where the correction coefficient KO2 is calculated in response to the output signal (voltage value) FVO2 delivered from the upstream $O_2$ sensor 16 and the output signal (voltage value) RVO2 delivered from the downstream $O_2$ sensor 17.

At a step S21, first and second lean/rich flags FAF1 and FAF2 are initialized. The first lean/rich flag FAF1 is set to a value of 1 when the output voltage value FVO2 from the upstream $O_2$ sensor 16 is higher than a reference voltage FVREF (e.g. 0.45 V), i.e., when the output voltage value FVO2 indicates a rich state of the supplied air-fuel mixture, and the second lean/rich flag FAF2 is set to the same value as that of the flag FAF1 upon the lapse of a predetermined time period from a time point the first lean/rich flag FAF1 has been inverted, i.e. when the flag FAF1 has been changed from 0 to 1 or 1 to 0. The flags FAF1 and FAF2 are both initialized to 0 when the output voltage FVO2 is lower than the reference voltage FVREF, and to 1 when the former is higher than the latter.

Then, at a step S22, the KO2 value is initialized. Specifically, if the present loop is immediately after the shift from the open loop control to the feedback control, or if the throttle valve 3 is suddenly opened during the feedback control mode of the engine, the learned value KREF calculated at a step S47, described hereinafter, is applied as an initial value of the KO2 value. If the present loop is in a condition other than the above conditions, no initialization of the KO2 value is executed at the step S22.

At the following step S23, it is determined whether or not the KO2 value has been initialized in the present loop. If it is determined that the KO2 value has been initialized, i.e. if the present loop is at the start of the feedback control, the program proceeds to steps S39 to S45, where an initial value of a P term-generating delay counter (hereinafter referred to as "the delay counter") CDLY1 is set and integral control (I term control) of the correction coefficient KO2 is executed in response to the values of the lean/rich flags FAF1 and FAF2. The delay counter CDLY1 measures a delay time from a time point the first lean/rich flag FAF1 is inverted to a time point the second lean/rich flag FAF2 is inverted, i.e. a time period from a time point the upstream $O_2$ sensor output FVO2 is inverted to a time point the proportional control (P term control) is executed.

At the step S39, it is determined whether or not the second lean/rich flag FAF2 is set to a value of 0. If FAF2=0, the program proceeds to the step S40 of FIG. 4*b*, where it is determined whether or not the first lean/rich flag FAF1 is set to a value of 0. On the other hand, if FAF2=1, the program proceeds to the step S43 of FIG. 4*b*, where it is determined whether or not the first lean/rich flag FAF1 is set to a value of 1. When the feedback control is being started, if FVO2<FVREF, both of the flags FAF1 and FAF2 are set to 0 as described above, and therefore, the program proceeds via the steps S39 and S40, where the answers to the respective questions are both affirmative (YES), to a step S41, where the delay counter CDLY1 is set to a predetermined negative value TDR1 (e.g. approx. 120 msec). The program proceeds to a step S42. If FVO2≧FVREF, both of the flags FAF1 and FAF2 are set to 1 as described before, and therefore, the program proceeds via the steps S39 and S43, where the answers to the questions are negative (NO) and affirmative (YES), respectively, to a step S44, where the delay counter CDLY1 is set to a predetermined positive value TDL1 (e.g. approx. 40 msec). The program then proceeds to the step S45. If the flag FAF2 is equal to a value of 0 and the flag FAF1 is equal to 1, the delay counter CDLY1 is not initialized, but a predetermined value I is added to the KO2 value at the step S42, to update the KO2 value, followed by the program proceeding to a step S46. On the other hand, if the flag FAF2 is equal to 1 and the flag FAF1 is equal to 0, the delay counter CDLY1 is not initialized, either, but the predetermined value I is subtracted from the KO2 value at the step S45 to update the KO2 value, followed by the program proceeding to the step S46.

If the answer to the question of the step S23 of FIG. 4*a* is negative (NO), i.e. if the KO2 value has not been initialized in the present loop, the program proceeds to a step S24, where it is determined whether or not the upstream $O_2$ sensor output voltage FVO2 is lower than the reference voltage FVREF. If FVO2<FVREF, i.e. if the air-fuel ratio is lean, the program proceeds to a step S25, where the first lean/rich flag FAF1 is set to a value of 0 and the delay counter CDLY1 is decreased by a decremental value of 1. Then, it is determined at a step S26 whether or not the count value of the delay counter CDLY1 is smaller than the predetermined negative value TDR1. If CDLY1<TDR1, the counter CDLY1 is set to the value TDR1 at a step S27, whereas if CDLY≧TDR, the program immediately proceeds to a step S31.

If the answer to the question of the step S24 is negative (NO), i.e. if FVO2≧FVREF, indicating that the air-fuel ratio is rich, the first lean/rich flag FAF1 is set to 1, and the delay counter CDLY1 is increased by an incremental value of 1. Then, it is determined at a step S29 whether or not the count value of the delay counter CDLY1 is larger than the predetermined positive value TDL1. If CDLY1>TDL1, the counter CDLY1 is set to the value TDL1 at a step S30, whereas if CDLY1≦TDL1, the program immediately proceeds to the step S31.

In this way, the steps S26, S27, S29 and S30 function so that the count value of the counter CDLY1 does not become smaller than the predetermined negative value TDR1 nor larger than the predetermined positive value TDL1.

At the step S31, it is determined whether or not the sign (plus or minus sign) of the count value of the counter CDLY1 has been inverted. If the sign has not been inverted, the I term control is executed at the steps S39 to S45, whereas if the sign has been inverted, the P term control is executed at steps S32 to S38.

At the step S32, it is determined whether or not the first lean/rich flag FAF1 is equal to a value of 0. If FAF1=0, the program proceeds to a step S33 of FIG. 4*b*, where the second lean/rich flag FAF2 is set to a value of 0, and then the count value of the delay counter CDLY1 is set to the predetermined negative value TDR1 at a step S34. Further, the correction coefficient KO2 is calculated at the step S35 by the use of the following equation (2), followed by the program proceeding to the step S46:

$$KO2=KO2+PR\times KP \quad (2)$$

where PR represents an enriching feedback control parameter and KP represents a control parameter correction coefficient. The PR value is calculated according to a PR/PL-determining routine of FIG. 5, described hereinafter, and the KP value is read from a map, not shown, which is set in accordance with the engine rotational speed NE and the intake pipe absolute pressure PBA.

If the answer to the question of the step S32 is negative (NO), i.e. if FAF1=1, the second lean/rich flag FAF2 is set to 1 at a step S36, and the count value of the delay counter CDLY1 is set to the predetermined positive value TDL at a step S37. Further, the correction coefficient KO2 is calculated at a step S38 by the use of the following equation (3), followed by the program proceeding to the step S46.

$$KO2=KO2-PL\times KP \quad (3)$$

where PL represents a leaning feedback control parameter. The PL value is calculated by the PR/PL-determining routine of FIG. 5 in the same manner as in the calculation of the PR value.

After the KO2 value is thus calculated at the step S35, S38, S42 or S45, at a step S46, limit check of the KO2 value is carried out, and the learned value KREF of the KO2 is calculated at the step S47. Further, limit check of the KREF value is carried out at a step S48, followed by terminating the present program.

Figure 5:
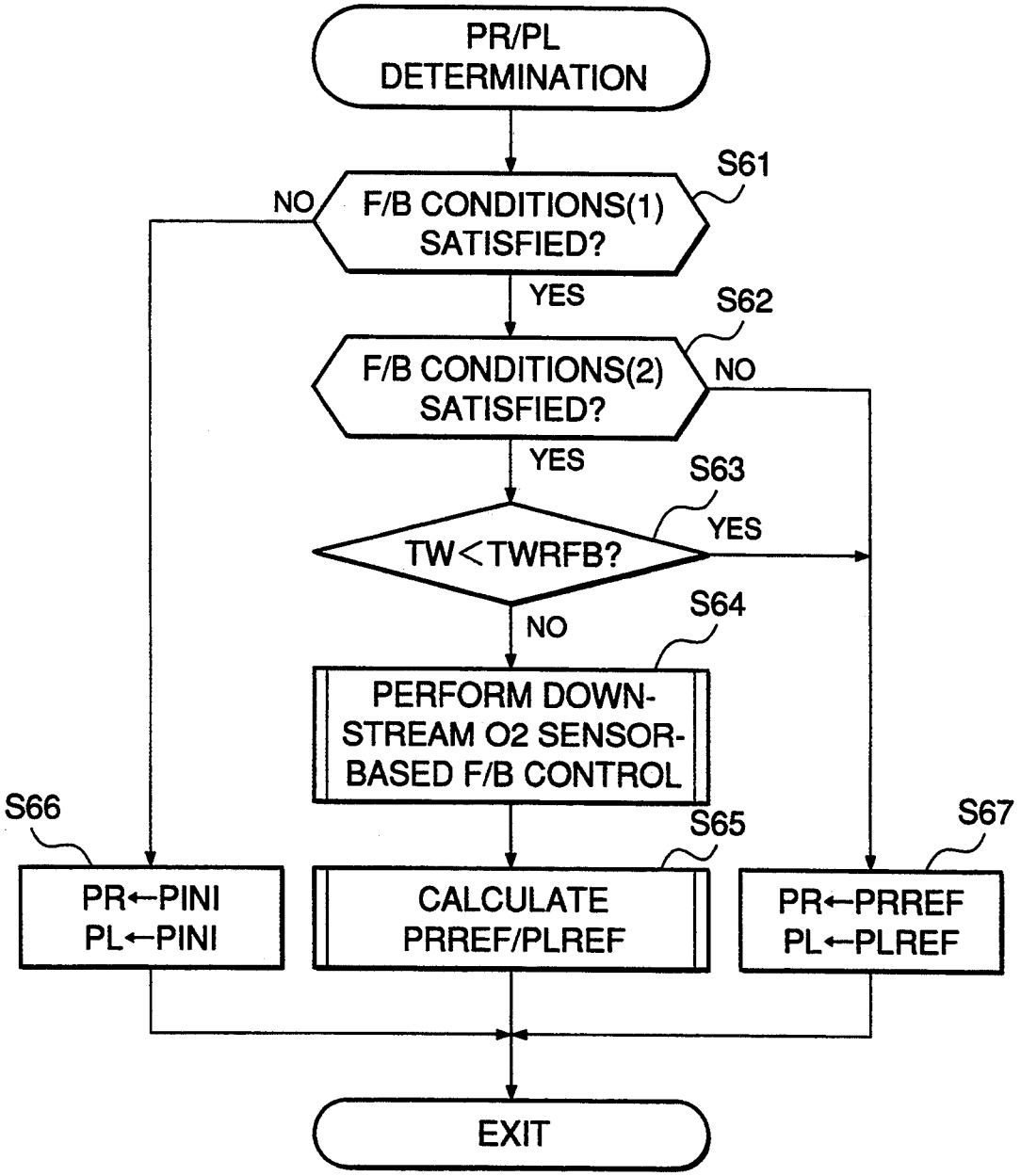
FIG. 5 is a flowchart of a PR/PL-determining routine for determining an enriching feedback control parameter PR and a leaning feedback control parameter PL.

FIG. 5 shows the PR/PL-determining routine for determining values of the enriching feedback control parameter PR and the leaning feedback control parameter PL, which is executed in synchronism with false signals generated by a timer, not shown, incorporated in the ECU 5, at predetermined fixed time intervals (e.g. 110 msec).

The enriching feedback control parameter PR and the leaning feedback control parameter PL are basically determined based on the output signal RVO2 from the downstream $O_2$ sensor 17 by the feedback control, permission of which is first determined at steps S61 and S62.

More specifically, at the step S61, it is determined whether or not feedback control conditions (1) are satisfied. The feedback control conditions (1) are determined to be satisfied e.g. when the downstream $O_2$ sensor 17 is normally operating, under the conditions for the upstream $O_2$ sensor 16-based feedback control being satisfied, and further, the engine 1 is not idling. If the feedback control conditions (1) are not satisfied, it is judged that the downstream $O_2$ sensor-based feedback control should be inhibited, setting the enriching and leaning feedback control parameters PR and PL to a predetermined value PINI stored in a ROM (read only memory), not shown, of the memory means 5c at a step S66.

On the other hand, if the answer to the question of the step S61 is affirmative (YES), i.e. if the feedback control conditions (1) are satisfied, it is determined at a step S62 whether or not feedback control conditions (2) are satisfied. The feedback control conditions (2) are determined to be satisfied e.g. when the downstream $O_2$ sensor 17 has been activated, and at the same time the engine is in a steady operating condition. If the feedback control conditions (2) are not satisfied, it is judged that the downstream $O_2$ sensor-based feedback control should be temporarily inhibited, setting the enriching and leaning feedback control parameters PR and PL to respective learned values PRREF and PLREF calculated at a step S65, referred to hereinafter, at a step S67.

If the answer to the question of the step S62 is affirmative (YES), i.e. if the feedback control conditions (2) are satisfied, it is determined at a step S63 whether or not the engine coolant temperature TW is lower than a second predetermined temperature TWRFB (e.g. 60° C.) higher than the first predetermined temperature TWO2 applied at the step S1 of the FIG. 3 routine. If TW<TWRFB, the program proceeds to the step S67, followed by terminating the program.

On the other hand, if the answer to the question of the step S63 is negative (NO), i.e. if TW≧TWRFB, the downstream $O_2$ sensor-based feedback control routine, described in detail hereinafter, is executed to determine the enriching and leaning feedback control parameters PR and PL based on the output signal (voltage value) RVO2 from the downstream $O_2$ sensor 17.

After determining the enriching and leaning feedback control parameters PR and PL, the program proceeds to a step S65, where the learned value PRREF of the enriching feedback control parameter and the learned value PLREF of the leaning feedback control parameter are calculated by the use of the following equations (4) and (5), respectively, and stored into a RAM (random access memory), not shown, of the memory means 5c.

$$PRREF = CPREF \times PR/A + (A - CPREF) \times PRREF(n-1)/A \quad (4)$$

$$PLREF = CPREF \times PL/A + (A - CPREF) \times PLREF(n-1)/A \quad 95)$$

where PRREF(n−1) and PLREF(n−1) on the right sides of the equations designate respective immediately preceding values of the learned values, A a constant which is set, e.g. to 655536, and CPREF an averaging coefficient for determining the rate of contribution of the present. PR and PL values to the resulting values PRREF and PLREF, which is set to a value within a range of 1 to A.

In this connection, the learned values PRREF and PLREF may be set to simple average values of the enriching and leaning feedback control parameters PR and PL, respectively.

According to the PR/PL-determining routine, if the feedback control conditions (1) and (2) are satisfied, and at the same time, the engine coolant temperature TW is equal to or higher than the second predetermined value TWRFB (i.e. TW TWRFB), the enriching feedback control parameter and the leaning feedback control parameter are determined based on the output signal RVO2 from the downstream $O_2$ sensor 17, and further the learned values PRREF and PLREF thereof are calculated and stored. On the other hand, even if the feedback control conditions (1) and (2) are satisfied, when the engine coolant temperature TW is lower than the second predetermined temperature TWRFB (TW<TWRFB), the enriching and leaning feedback control parameters are set to the learned values PRREF and PLREF thereof, respectively. This enables the upstream $O_2$ sensor-based feedback control to be performed properly when the downstream $O_2$ sensor-based feedback control is temporarily inhibited, since the average values PRREF and PLREF reflect a change in the output characteristic of the upstream $O_2$ sensor 16, e.g. caused by aging thereof, in a compensating manner, which makes it possible to prevent the air-fuel ratio of the mixture supplied to the engine from being deviated from a desired value.

Figure 6A:
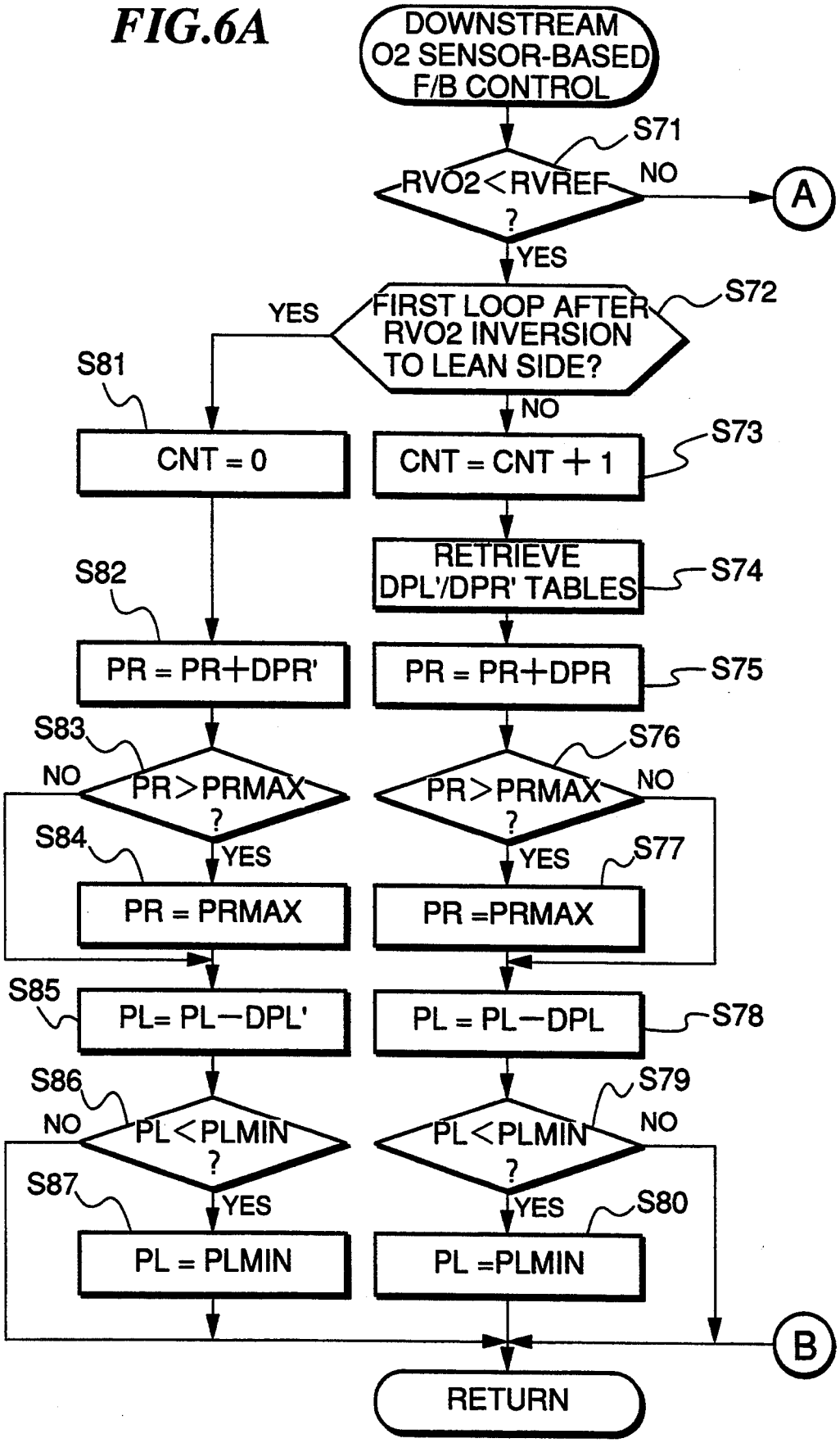
FIG. 6*a* is part of a flowchart showing a routine of a downstream $O_2$ sensor-based air-fuel ratio feedback control executed based on an output signal from a downstream $O_2$ sensor.
Figure 6B:
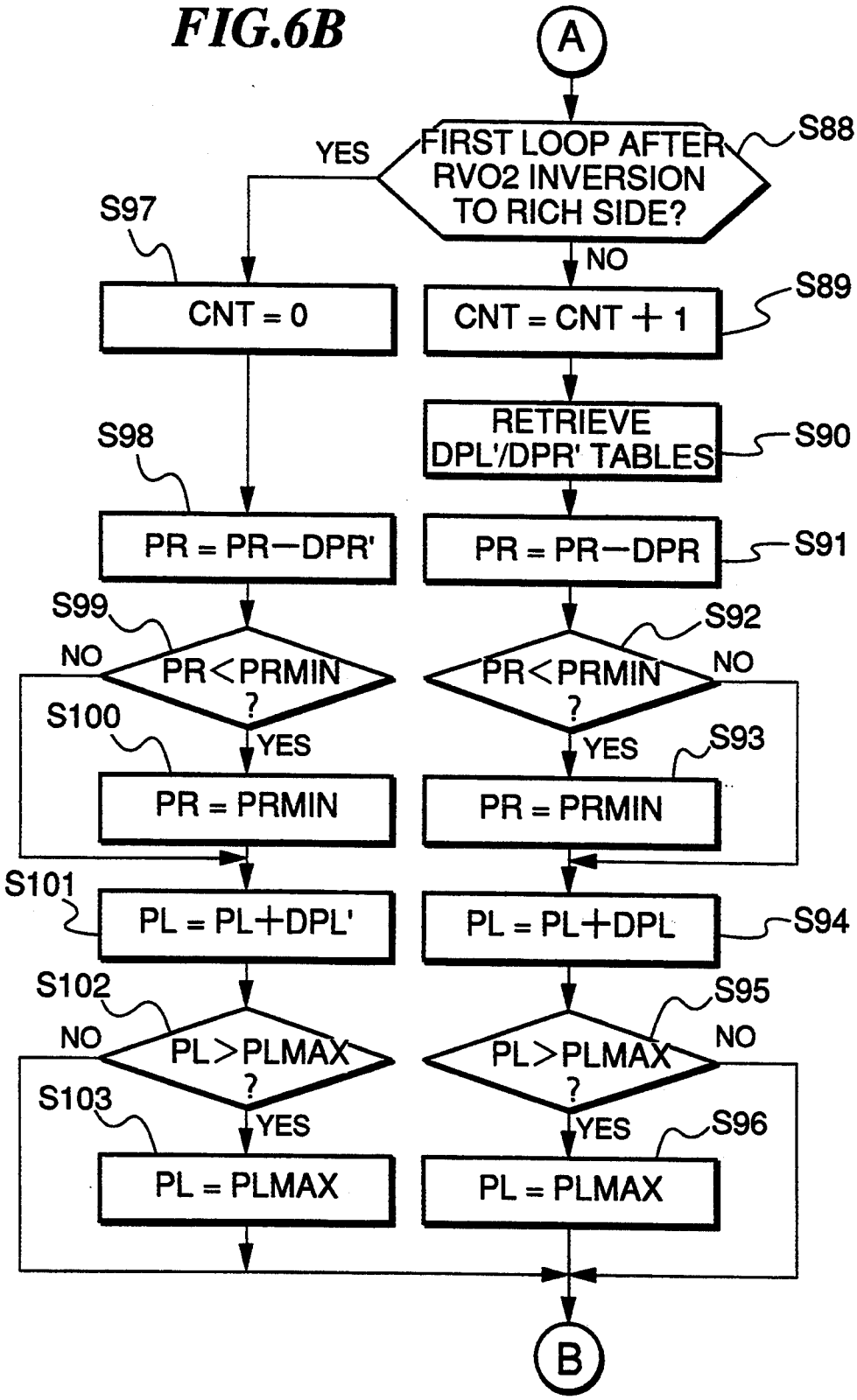
FIG. 6*b* is the remaining part of the FIG. 6*a* flowchart.

FIG. 6a and FIG. 6b show the downstream $O_2$ sensor-based feedback control routine, in which the enriching and leaning feedback control parameters (PR, PL) are determined by proportional-integral control (PI control) using proportional factors (DPR', DPL') and integral factors (DPR, DPL), and further, the proportional factors (DPR', DPL') are changed according to a repetition period of inversion of the output signal RVO2 from the downstream $O_2$ sensor (more specifically, according to a duration of the rich or lean state of the output signal RVO2 from the downstream $O_2$ sensor).

At a step S71, the output signal (voltage value) RVO2 from the downstream $O_2$ sensor 17 is compared with a predetermined reference voltage RVREF (e.g. 0.45 V) to determine whether the air-fuel mixture supplied to the engine is lean or rich (i.e. the air-fuel ratio of the mixture assumes a lean value or a rich value). If the former is lower than the latter (RVO2<RVREF), it is judged that the mixture is lean, and the program proceeds to a step S72, where it is determined whether or not the present loop is immediately after the output signal RVO2 from the downstream $O_2$ sensor 17 has been inverted from the richer side to the leaner side. If the answer to this question is negative (NO), i.e. if the present loop is not immediately after inversion of the signal, the program proceeds to a step S73, where the count value CNT of a repetition period counter, not shown, is increased by an incremental value of 1. The repetition period counter counts up whenever the step S73 is executed to thereby measure a time period over which the integral term control (I term control) is being executed at steps S75 to S80 under the condition of the negative answer (NO) to the question of the step S72, i.e. a duration of the lean value of the air-fuel ratio. Then, the program proceeds to a step S74, where a DPL' table and a DPR' table are retrieved to determine the proportional factor DPL' for use in calculation of the enriching feedback control parameter PR and the proportional factor DPR' for use in calculation of the leaning feedback control parameter PL, which are then stored into the RAM of the memory means 5c.

Figure 7:
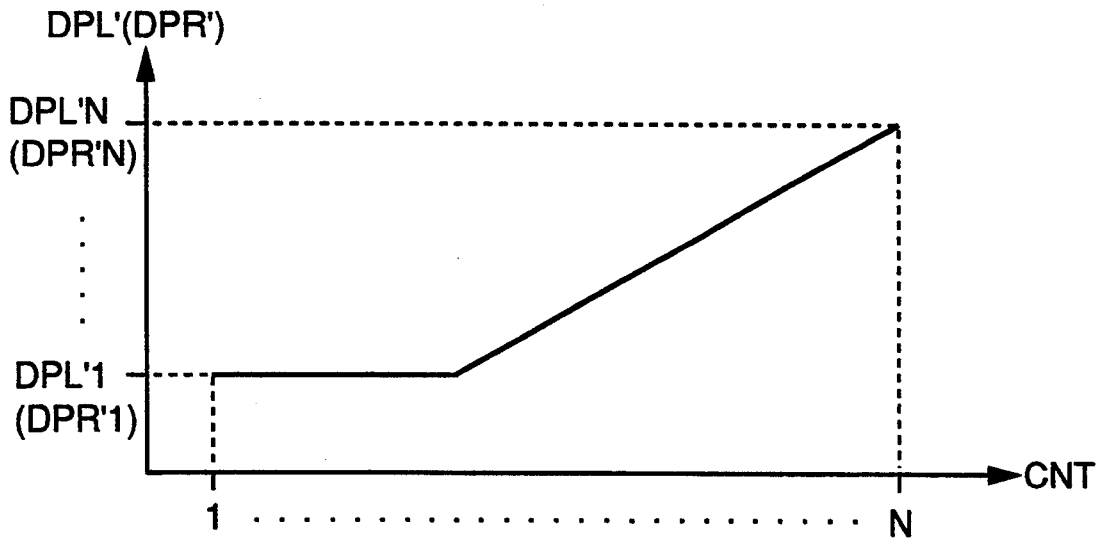
FIG. 7 shows a DPL'(DPR') table.

The DPL' table and the DPR' table are set, e.g. as shown in FIG. 7, such that table values DPL'1 to DPL'N and DPR'1 to DPR'N are provided in a manner corresponding to count values CNT1 to CNTN. The variable DPL' and the variable DPR' are determined by retrieving the DPL' table and the DPR' table according to the count value CNT of the repetition period counter. In this connection, as is clearly understood from FIG. 7, the proportional factors DPL' and DPR' are set to larger values as the count value CNT of the repetition period counter is larger, i.e. as the duration of the lean value of the air-fuel ratio is longer.

Then, the program proceeds to a step S75, where the predetermined integral factor DPR for use in calculation of the enriching feedback control parameter PR is added to the enriching feedback control parameter PR to update the enriching feedback control parameter PR, and at the following step S76, it is determined whether or not the updated enriching feedback control parameter PR is larger than a predetermined upper limit value PRMAX. If the answer to this question is negative (NO), the program jumps over to a step S78, whereas if the answer is affirmative (YES), the updated enriching feedback control parameter is corrected to the predetermined upper limit value PRMAX at step S77, and then the program proceeds to the step S78. Then, the predetermined integral factor DPL for use in calculation of the leaning feedback control parameter PL is subtracted from the leaning feedback control parameter PL to update the leaning feedback control parameter PL at the step S78. At the following step S79, it is determined whether or not the updated leaning feedback control parameter is smaller than a predetermined lower limit value PLMIN. If the answer to this question is negative (NO), the program is immediately terminated, whereas if the answer is affirmative (YES), the updated leaning feedback control parameter is corrected to the predetermined lower limit value PLMIN at a step S80, followed by terminating the program.

If the answer to the question of the step S72 is affirmative (YES), i.e. if the present loop is immediately after the output signal RVO2 from the downstream $O_2$ sensor 17 has been inverted from the richer side to the leaner side, the program proceeds to a step S81, where the count value CNT of the repetition period counter is reset to 0, and at the following step S82, a value of the proportional factor DPR' determined at a step S90, referred to hereinafter, is added to the enriching feedback control parameter PR to update the enriching feedback control parameter PR. Then, it is determined at a step S83 whether or not the updated enriching feedback control parameter PR is larger than the predetermined upper limit value PRMAX. If the answer to this question is negative (NO), the program jump over to a step S85, whereas if the answer is affirmative (YES), the updated enriching feedback control parameter is corrected to the predetermined upper limit value PRMAX at a step S84, and then the program proceeds to the step S85. At the step S85, a value of the proportional factor DPL' determined at the step S90 is subtracted from the leaning feedback control parameter PL to update the leaning feedback control parameter PL, and at the following step S86, it is determined whether or not the updated leaning feedback control parameter is smaller than the lower limit value PLMIN. If the answer to this question is negative (NO), the program is immediately terminated, whereas if the answer is affirmative (YES), the updated leaning feedback control parameter is corrected to the predetermined lower limit value PLMIN at a step S87, followed by terminating the program.

Thus, immediately after the output signal RVO2 from the downstream $O_2$ sensor 17 has been inverted from the richer side to the leaner side, the enriching feedback control parameter PR is largely increased according to the proportional factor DPR' and the leaning feedback control parameter PL is largely decreased according to the proportional factor DPL'. That is, when the repetition period of inversion of the output signal RVO2 from the downstream $O_2$ sensor 17 is longer, and hence the proportional factors DPL' and DPR' are larger, the enriching feedback control parameter is increased by a larger incremental value (i.e. DPR') and the leaning feedback control parameter is decreased by a larger decremental value (i.e. DPL') (see the steps S82 and S85), thereby reducing deviation of the air-fuel ratio correction coefficient KO2 from a proper value.

On the other hand, if the answer to the question of the step S71 is negative (NO), i.e. if the mixture is rich, the program proceeds to the step S88 in FIG. 6b, where it is determined whether or not the present loop is immediately after the output signal RVO2 from the downstream $O_2$ sensor 17 has been inverted from the the leaner side to the richer side. If the answer to this question is negative (NO), i.e. if the present loop is not immediately after inversion of the signal, the program proceeds to a step S89, where the count value CNT of the repetition period counter is increased by an incremental value of 1. Then, the program proceeds to the step S90, where the DPL' table and the DPR' table (see FIG. 7) are retrieved to determine the proportional factors DPL' and DPR', similarly to the step S74 described hereinabove, and values of the proportional factors DPL' and DPR' corresponding to a duration of the rich value of the output signal RVO2 from the downstream O2 sensor 17 are determined and then stored into the RAM of the memory means 5c.

Then, the program proceeds to a step S91, where the predetermined integral factor DPR is subtracted from the enriching feedback control parameter PR to update the enriching feedback control parameter PR, and at the following step S92, it is determined whether or not the updated enriching feedback control parameter PR is smaller than a predetermined lower limit value PRMIN. If the answer to this question is negative (NO), the program jumps over to a step S94, whereas if the answer is affirmative (YES), the updated enriching feedback control parameter is corrected to the predetermined lower limit value PRMIN at step S93, and then the program proceeds to the step S94, where the predetermined integral factor DPL is added to the leaning feedback control parameter PL to update the leaning feedback control parameter PL. At the following step S95, it is determined whether or not the updated leaning feedback control parameter is larger than a predetermined upper limit value PLMAX. If the answer to this question is negative (NO), the program is immediately terminated whereas if the answer is affirmative (YES) the updated leaning feedback control parameter is corrected to the predetermined upper limit value PLMAX at a step S96, followed by terminating the program.

If the answer to the question of the step S88 is affirmative (YES), i.e. if the present loop is immediately after the output signal from the downstream $O_2$ sensor 17 has been inverted from the leaner side to the richer side, the program proceeds to a step S97, where the count value CNT of the repetition period counter is reset to 0, and at the following step S98, the value of the proportional factor DPR' determined at the step S74, referred to hereinbefore, is subtracted from the enriching feedback control parameter PR to update the enriching feedback-control parameter PR. Then, it is determined at a step S99 whether or not the updated enriching feedback control parameter PR is smaller than the predetermined lower limit value PRMIN. If the answer to this question is negative (NO), the program jump over to a step S101, whereas if the answer is affirmative (YES), the updated enriching feedback control parameter is corrected to the predetermined lower limit value PRMIN at a step S100, and then the program proceeds to the step S101. At the step S101, a value of the proportional factor DPL' determined at the step S74 is added to the leaning feedback control parameter PL to update the leaning feedback control parameter PL, and at the following step S102, it is determined whether or not the updated leaning feedback control parameter is larger than the upper limit value PLMAX. If the answer to this question is negative (NO), the program is immediately terminated, whereas if the answer is affirmative (YES), the updated leaning feedback control parameter is corrected to the predetermined upper limit value PLMAX at a step S103, followed by terminating the program.

Thus, immediately after the output signal RVO2 from the downstream $O_2$ sensor 17 has been inverted from the leaner side to the richer side, the enriching feedback control parameter PR is decreased according to the proportional factor DPR' and the leaning feedback control parameter PL is increased according to the proportional factor DPL'. That is, when the repetition period of inversion of the output signal from the downstream $O_2$ sensor 17 is longer, and hence the proportional factors DPL' and DPR' are larger, the enriching feedback control parameter PR is decreased by a larger decremental value (i.e. DPR') and the leaning feedback control parameter PL is increased by a larger incremental value (i.e. DPL') (see the steps S98 and S101), thereby reducing deviation of the air-fuel ratio correction coefficient KO2 from a proper value.

As described above, according to the present embodiment, the proportional factors DPL' and DPR' are determined according to a duration of the I term control executed so long as the the output signal RVO2 from the downstream O2 sensor 17 continues to be lean or rich, and stored into the RAM of the memory means 5*c*. Then, the enriching feedback control parameter PR and the leaning feedback control parameter PL, which are calculated by the use of the proportional factors DPR' and DPL', are applied to the calculation of the air-fuel ratio correction coefficient KO2, as described hereinabove with reference to FIGS. 4*a* and 4*b*. This makes it possible to suppress overshoot of the air-fuel ratio feedback control caused by variation in the repetition period of inversion of the air-fuel ratio coefficient KO2, described hereinabove in the section of Prior Art, resulting in an enhanced exhaust emission characteristic.

Figures 8A, 8B, 8C:
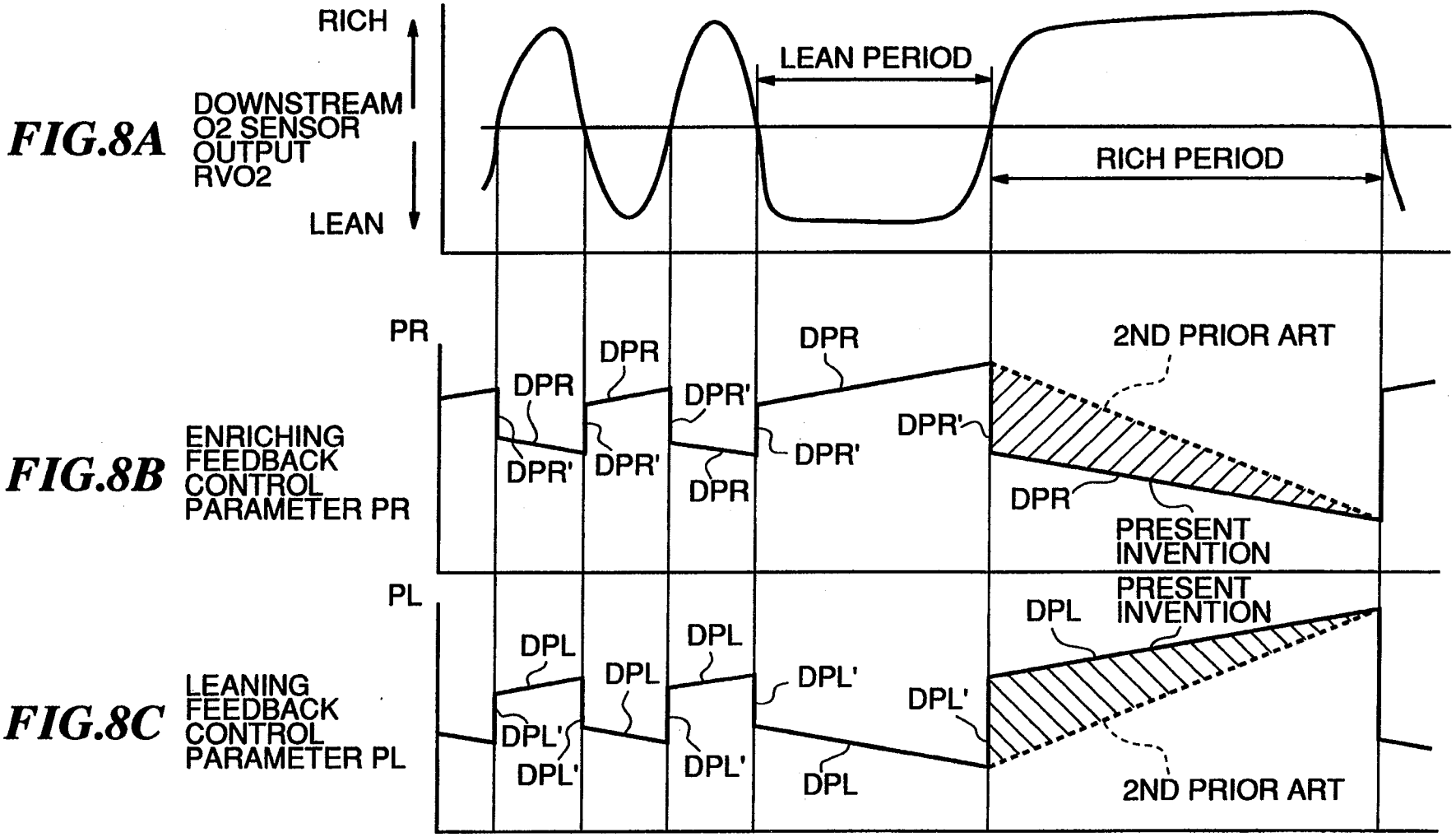
Figure 9:
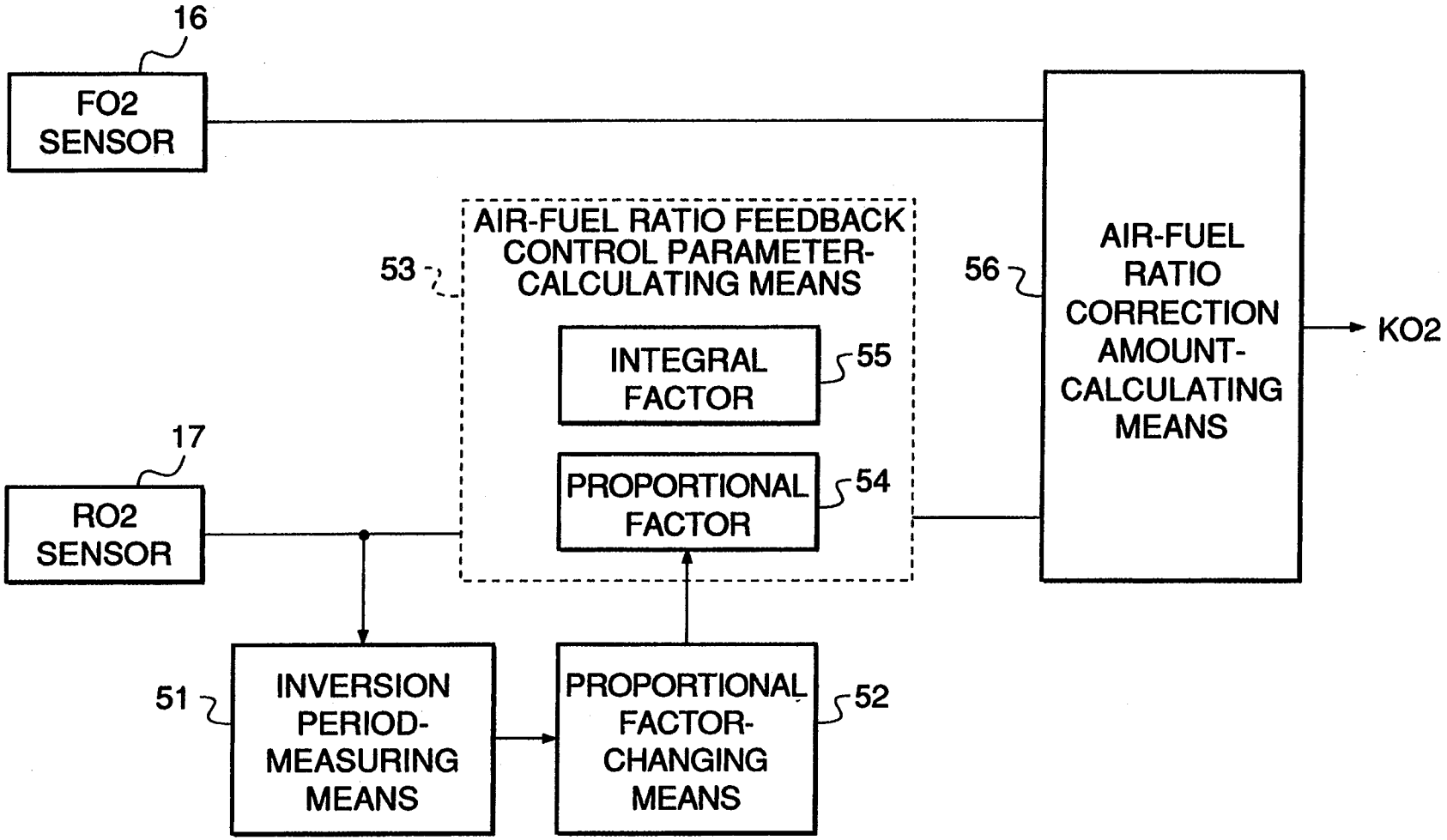
FIG. 9 is a block diagram which is useful in explaining the gist of the invention.

FIG. 8*a* to FIG. 8*c* show changes in the enriching feedback control parameter PR and the leaning feedback control parameter PL determined based on the output signal RVO2 from the downstream $O_2$ sensor 17 in the manner described above.

Immediately after the output signal RVO2 from the downstream $O_2$ sensor 17 has been inverted from the leaner side to the richer side, the enriching feedback control parameter PR is decreased by the use of the proportional factor DPR' in a stepped manner as shown in FIG. 8*b*, whereas the leaning feedback control parameter PL is increased by the use of the proportional factor DPL' in a stepped manner as shown in FIG. 8*c*. Thereafter, the enriching feedback control parameter PR is progressively decreased by the use of the integral factor DPR and the leaning feedback control parameter PL is progressively increased by the use of the integral factor DPL. Immediately after the output signal RVO2 from the downstream $O_2$ sensor 17 has been inverted from the richer side to the leaner side, the enriching feedback control parameter is increased by the use of the proportional factor DPR' in a stepped manner as shown in FIG. 8*b*, whereas the leaning feedback control parameter is decreased by the use of the proportional factor DPL' in a stepped manner as shown in FIG. 8*c*. Thereafter, the enriching feedback control parameter PR is progressively increased by the use of the integral factor DPR and the leaning feedback control parameter PL is progressively decreased by the use of the integral factor DPL. As the time period over which the output signal RVO2 from the downstream $O_2$ sensor 17 is on the richer side or on the leaner side is shorter, i.e. the repetition period of inversion of the output signal RVO2 from same is shorter, the proportional factors DPL' and DPR' are smaller, whereas as the time period over which the output signal RVO2 from the downstream $O_2$ sensor 17 is on the richer side or on the leaner side is longer, i.e. the repetition period of inversion of the output signal from same is longer, the proportional factors DPL' and DPR' are larger. Therefore, as the repetition period of inversion of the output signal RVO2 from the downstream $O_2$ signal 17 is the longer, the enriching feedback control parameter PR is set to the smaller value and the leaning feedback control parameter PL is set to the larger value, immediately after the output signal RVO2 from the downstream $O_2$ signal 17 has been inverted from the leaner side to the richer side, whereas the enriching feedback control parameter PR is set to the larger value and the leaning feedback control parameter PL is set to the smaller value, immediately after the output signal RVO2 from the downstream $O_2$ signal 17 has been inverted from the richer side to the leaner side. More specifically, in the case of the prior art system described in the section of Prior Art, the enriching feedback control parameter and the leaning feedback control parameter are progressively decreased or increased by changing the integral factors DPR and DPL. In contrast, according to the present invention, the enriching feedback control parameter and the leaning feedback control parameter are drastically deceased or increased immediately after the output signal RVO2 from the downstream $O_2$ sensor 17 has been inverted, and then the I term control for calculation of the proportional factors DPR' and DPL' is started, whereby the air-fuel ratio can be feedback-controlled with responsiveness which is improved by a degree corresponding to shaded parts in FIG. 8*b* and FIG. 8*c*, to thereby enhance exhaust emission characteristics of the engine.

Although in the above embodiment, as the air-fuel ratio feedback control parameter based on the output signal from the downstream $O_2$ sensor, the proportional parameters (PR, PL) are used, this is not limitative, but an integrating parameter, a delay time in the inversion of the upstream $O_2$ sensor, or a reference voltage for the upstream $0_2$ sensor may be used in place of the proportional parameters.

What is claimed is:

1. In an air-fuel ratio control system for an internal combustion engine having an exhaust passage, a catalytic converter arranged in said exhaust passage for purifying noxious components contained in exhaust gases, including a first air-fuel ratio sensor arranged in said exhaust passage at a location upstream of said catalytic converter, and a second air-fuel ratio sensor arranged in said exhaust passage at a location downstream of said catalytic converter, air-fuel ratio feedback control parameter-calculating means for calculating an air-fuel ratio feedback control parameter, by proportional-integral control using a proportional factor and an integral factor, based on an output signal from said second air-fuel ratio sensor, and air-fuel ratio correction amount-calculating means for calculating said air-fuel ratio correction amount based on said air-fuel ratio feedback control parameter and an output signal from said first air-fuel ratio sensor, the improvement comprising:

inversion period-measuring means for measuring a repetition period of inversion of said output signal from said second air-fuel ratio sensor; and proportional factor-changing means for changing said proportional factor according to said repetition period of inversion of said output signal from said second air-fuel ratio sensor detected by said repetition period-measuring means.

2. An air-fuel ratio sensor for an internal combustion engine according to claim 1, wherein said proportional factor-changing means sets said proportional factor to a larger value as said repetition period of inversion of said output signal from said second air-fuel ratio sensor becomes longer.

3. An air-fuel ratio sensor for an internal combustion engine according to claim 2, wherein said air-fuel ratio feedback control parameter is comprised of a leaning feedback control parameter applied in changing the air-fuel ratio of a mixture in a leaning direction, and an enriching feedback control parameter applied in changing the air-fuel ratio of said mixture in an enriching direction.

4. An air-fuel ratio sensor for an internal combustion engine according to claim 2, wherein the calculation of said air-fuel ratio feedback control parameter by said air-fuel ratio feedback control parameter-calculating means is permitted to be executed, when said engine is in a predetermined steady operating condition.

5. An air-fuel ratio sensor for an internal combustion engine according to claim 4, including learned value-calculating means for calculating a learned value of said air-fuel ratio feedback control parameter, wherein said learned value-calculating means calculates said learned value when calculation of said air-fuel ratio feedback control parameter is permitted, and said air-fuel ratio correction amount-calculating means calculates said air-fuel ratio correction amount based on said learned value when said calculation of said air-fuel ratio feedback control parameter is inhibited, when the calculation of said air-fuel ratio feedback control parameter by said air-fuel ratio feedback control parameter-calculating means is inhibited.

* * * * *